US007300261B2

(12) United States Patent
Cafri et al.

(10) Patent No.: US 7,300,261 B2
(45) Date of Patent: Nov. 27, 2007

(54) VIBRATION DAMPER WITH NESTED TURBO MOLECULAR PUMP

(75) Inventors: Hagay Cafri, Nes-Ziona (IL); Eyal Kotik, Kiryat Motzkin (IL); Eitan Pinhasi, Beny Brak (IL); Igor (Krayvitz) Krivts, Rehovot (IL)

(73) Assignee: Applied Materials, Inc., Santa Clara, CA (US)

( * ) Notice: Subject to any disclaimer, the term of this patent is extended or adjusted under 35 U.S.C. 154(b) by 200 days.

(21) Appl. No.: 10/622,276

(22) Filed: Jul. 18, 2003

(65) Prior Publication Data

US 2005/0013703 A1 Jan. 20, 2005

(51) Int. Cl.
*B01D 8/00* (2006.01)
*F04B 17/03* (2006.01)

(52) U.S. Cl. ..... 417/363; 417/423.4; 417/423.14; 417/423.15; 62/55.5

(58) Field of Classification Search ..... 417/363, 417/423.4, 423.15, 423.14; 62/55.5
See application file for complete search history.

(56) References Cited

U.S. PATENT DOCUMENTS 4,352,643 A * 10/1982 Iijima ..... 417/313
4,363,217 A * 12/1982 Venuti ..... 62/55.5
4,526,015 A * 7/1985 Laskaris ..... 62/51.1
4,806,075 A 2/1989 Osterstrom et al.
4,835,972 A * 6/1989 Tugal et al. ..... 62/50.1
6,120,606 A 9/2000 Peng
6,575,713 B2 * 6/2003 Ohtachi et al. ..... 417/353
6,619,911 B1 * 9/2003 Englander et al. ..... 415/90
6,867,521 B2 * 3/2005 Beyer et al. ..... 310/90.5
6,899,529 B2 * 5/2005 Ishikawa et al. ..... 417/363
2001/0012488 A1 8/2001 Ohtachi et al.
2002/0109090 A1 8/2002 Nakasuji et al.

* cited by examiner

*Primary Examiner*—Charles G Freay
(74) *Attorney, Agent, or Firm*—Sughrue Mion PLLC

(57) ABSTRACT

A gas turbo pump assembly for connection to a port of a vacuum chamber and having high throughput with low vibration. The assembly comprises a turbo pump and a vibration damper. The pump has a pump body with an external surface and a center axis defining a first axial end and a second axial end of the pump. The pump also has a pump inlet port, the inlet port being coupled to the vacuum chamber port disposed at the first axial end of the pump, and an exit port disposed proximate the second axial end of the pump. The assembly vibration damper is structured to enclose a substantial portion of the pump in a nested arrangement.

22 Claims, 6 Drawing Sheets

230"
252
253
254
255
248
230"
261
230"
252
253
204
248
211
202
203
205B
C
C
205A
210
246
248
247
201
262
250
280
270
260

VIBRATION DAMPER WITH NESTED TURBO MOLECULAR PUMP

BACKGROUND OF THE INVENTION

The present invention concerns vacuum pumps and, in particular, turbo molecular pumps that are used in semiconductor manufacturing processes requiring a vacuum environment with a pressure lower than atmospheric pressure. More specifically, the present invention concerns the use of vibration dampers between the vacuum pump and a vacuum environment, such as a vacuum chamber, in order to isolate the vacuum environment from any vibration generated by the pump.

In semiconductor manufacturing processes, a variety of steps, from layer or film deposition to inspection, are performed in a vacuum environment. However, because the vacuum pump is constructed with extremely tight tolerances extending down to the millimeter range, which enables operation with free molecular flow, the pump can be the source of a significant problem with vibration. This problem is particularly acute with turbo molecular pumps, having a floated rotor and stator construction, where rotational speeds are attained in the range of 50,000 rpm or greater.

The achievement of proper vibration isolation between the pump and the vacuum chamber is particularly important where the semiconductor structure is in the submicron range. The unwanted effects of vibration include errors in line deposition and film formation, and even errors in the inspection and quality assurance process, where extremely high accuracy in comparing patterns on a manufactured substrate against a reference pattern is required, and vibration anomalies may lead to erroneous decisions on product quality.

Such problems arise in inspection systems using scanning electron microscopes (SEM) or comparably sensitive devices, having less than one micron field of view, where inspection of a specimen (typically a wafer) is performed with the generation of an electron beam applied in a specimen chamber that must be maintained in a low pressure and contamination-free environment.

An example of a conventional turbo-molecular pump of the type manufactured by Varian Corp. or Pfiffer Edwards is illustrated in FIG. 1, where the pump 100 has a cylindrical outer body 101. As illustrated in the figure, the pump has a central axis C-C and an inlet port 103 defined by a rim 102 that is adapted to attach directly, or be coupled via a conduit or manifold, to a vacuum chamber (not shown). At an opposite axial end of the cylinder body 101 is an exhaust port 104 to which the contents of the vacuum chamber are exhausted. The pump exhaust port is radially disposed with regard to the central axis C-C and is located on one side of the pump body 101. Preferably, a conduit 105 for electrical, hydraulic, gas purge and cooling hose connections (collectively 130) is also radially disposed. At the same axial end, the bottom of the pump body has a sealing plate 106 that is removable but also serves as a support. The interior of the body 101 defines a chamber containing a rotor 107 that is disposed for rotation along the axis C-C and is supported by magnetic bearings 108 and mechanical bearings 109. The rotor 107 drives rotating blades 110, which are disposed radially with respect to the central axis C-C. Stator blades 111, also disposed radially and interposed between the rotator blades 110, are affixed to a support adjacent to the inner surface of the body 101, in a manner well known in the art. The rotor 107 is supported by a frame 112, and is mounted to the body 101 by vibration damping connectors 113 via arms 114 on the rotor body 112. A motor 115 is operative to drive the rotor 107 at high speed, in the range of approximately 50,000 rpm or higher.

A coupling of the molecular-turbo pump 100 to a vacuum chamber is conventionally implemented with the use of a vibration damper 150, as illustrated in FIG. 2. Elements in FIG. 2 having a reference numeral identical to those in FIG. 1 refer to the same structure and are not further described. The vibration damping mechanism 150 is coupled at one end to the rim 102 of the pump 100 at input 103 via a lower clamp 160 and is coupled at the other end to the inlet port 180 via an upper clamp 170. The clamp 160 fits around the rim 102 and a lower distal end 151A of the vibration damping structure 150 and is secured by a plurality of bolts (unnumbered). At the opposite distal end 151B of the vibration damping structure, clamp 170 serves to couple the vibration damper 150 to the structure of the vacuum chamber inlet port 180 and is similarly secured by a plurality of bolts (unnumbered). The coupling of the turbo molecular vacuum pump 100 to the inlet port 180 via the vibration damper 150 defines a "serial-coupled" damper and vacuum pump arrangement. One or more centering rings 162 (which are conventional and available off the shelf, for example, at www.duniway.com) may be secured by the clamps 160, 170 and sealed by an O-ring 161, as is known in the art.

The vacuum damper 150 comprises a rubberized support 152 that extends between the connector portions 151A and 151B at the opposite distal ends of the damper. The structure is made of a hardened rubber and has coupled to its interior surface a plurality of baffles 153. The vacuum damper 150 is a conventional design that is available off-the-shelf from several vendors.

Although the serial type arrangement illustrated in FIG. 2 eliminates some of the vibration that originates in the pump 100, there continues to remain a problem with residual vibration. As illustrated by U.S. patent Pub. 2001/0012488 to Ohtachi et al, entitled VACUUM PUMP, particularly in FIG. 4 of the Otachi et al publication, a series type connection may be used in which a damper is interposed between an input port of an external container and an outer cylindrical portion of a vacuum pump in order to prevent pump-origin vibration from being propagated to the external container. The damper uses a thin SUS-made cylindrical member bent into a bellow shape, which is coated with a silicon rubber or the like. The damper has a natural frequency of 20 Hz or less. However, the damper requires extra space in the axial direction of about 10 cm, thereby increasing the size, complexity of the structure, and cost of construction, assembly and maintenance. In order to resolve this problem, the Ohtachi et al patent depresses the propagation of vibrations to an external container without the use of a damper, by applying a vibration-absorbing member between a stator portion and a base. Nonetheless, as illustrated in FIG. 5 of the Otachi et al publication, a bellows and extended flange continues to be required. The disadvantage of such a system is that vacuum power is significantly decreased. The additional distance between the pump input port and the input port of the vacuum chamber, as well as the bellows structure itself, reduces the effective speed of the pump. Thus, for a given pumping requirement, a much larger and more expensive pump is required.

The present invention is intended to solve this problem by allowing a direct connection between the pump and a vacuum chamber inlet port, thereby increasing conductance with accompanying reduction in resistance, while providing vibration damping with a damper assembled in a nested fashion about the pump. The nested arrangement may be considered a parallel, rather than serial connection of the damper structure.

SUMMARY OF THE INVENTION

The present invention is a gas turbo pump assembly for connection to an inlet port of a vacuum chamber, which defines a rigid mounting structure, the assembly having high throughput with low vibration. The assembly comprises a turbo pump having a pump body with an external surface and a center axis defining a direction of gas flow from a first axial end toward a second axial end of said body. The pump also has a pump inlet port, the inlet port being coupled to the vacuum chamber port disposed at the first axial end of the body, and an exit port disposed proximate the second axial end of the body. The assembly further has a vibration damper, structured to enclose a major portion of the pump body in a nested arrangement.

In a further feature of the invention, the vibration damper has at least one flexible structure, preferably a bellow damper, that connects between the body of the pump and the rigid mounting structure and encloses a major portion of the body of the pump.

The invention further involves a method of reducing the effect of vibration in a gas turbo pump assembly for connection to an inlet port of a vacuum chamber, which defines a rigid mounting structure, so that the assembly has high throughput with low vibration. The method comprises the step of providing a mounting structure on said turbo pump at a first axial end; and a step of connecting a vibration damping assembly to said rigid mounting structure at one end thereof and to the turbo pump at another end thereof in order to enclose a major portion of the turbo pump in a nested arrangement.

DESCRIPTION OF THE PREFERRED EMBODIMENTS

While the present invention is described in accordance with certain exemplary embodiments, it is not limited thereto. Numerous alternative structures and corresponding embodiments would be understood by one of ordinary skill in the art based upon the particular embodiments disclosed herein. When presenting the different embodiments, like structures are given the same reference number for consistency. The embodiments presented are only exemplary and the present invention is defined by the appended claims.

Figure 1:
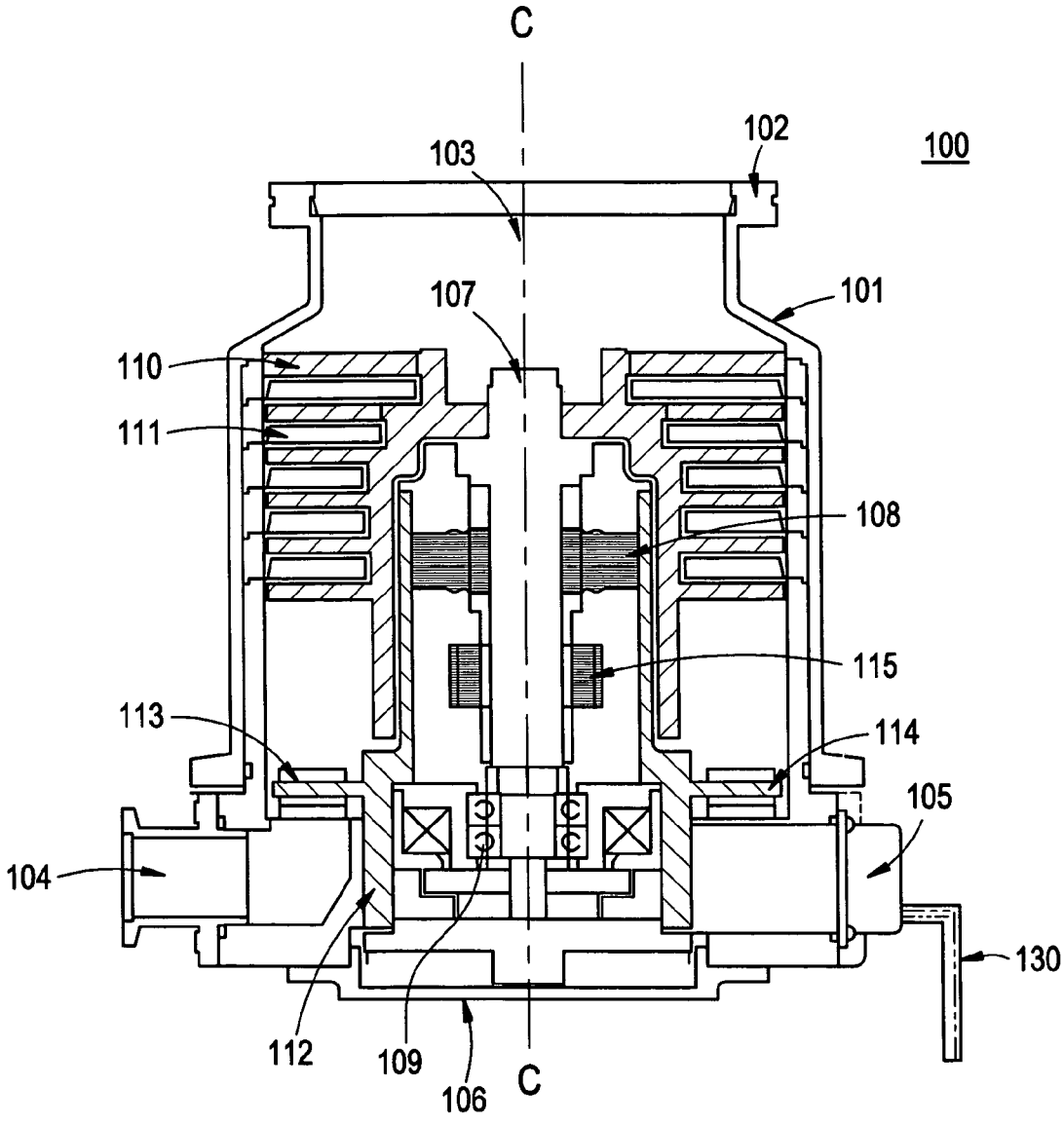
FIG. 1 PRIOR ART
FIG. 1 is a schematic illustration of a prior art turbo molecular vacuum pump.
Figure 3:
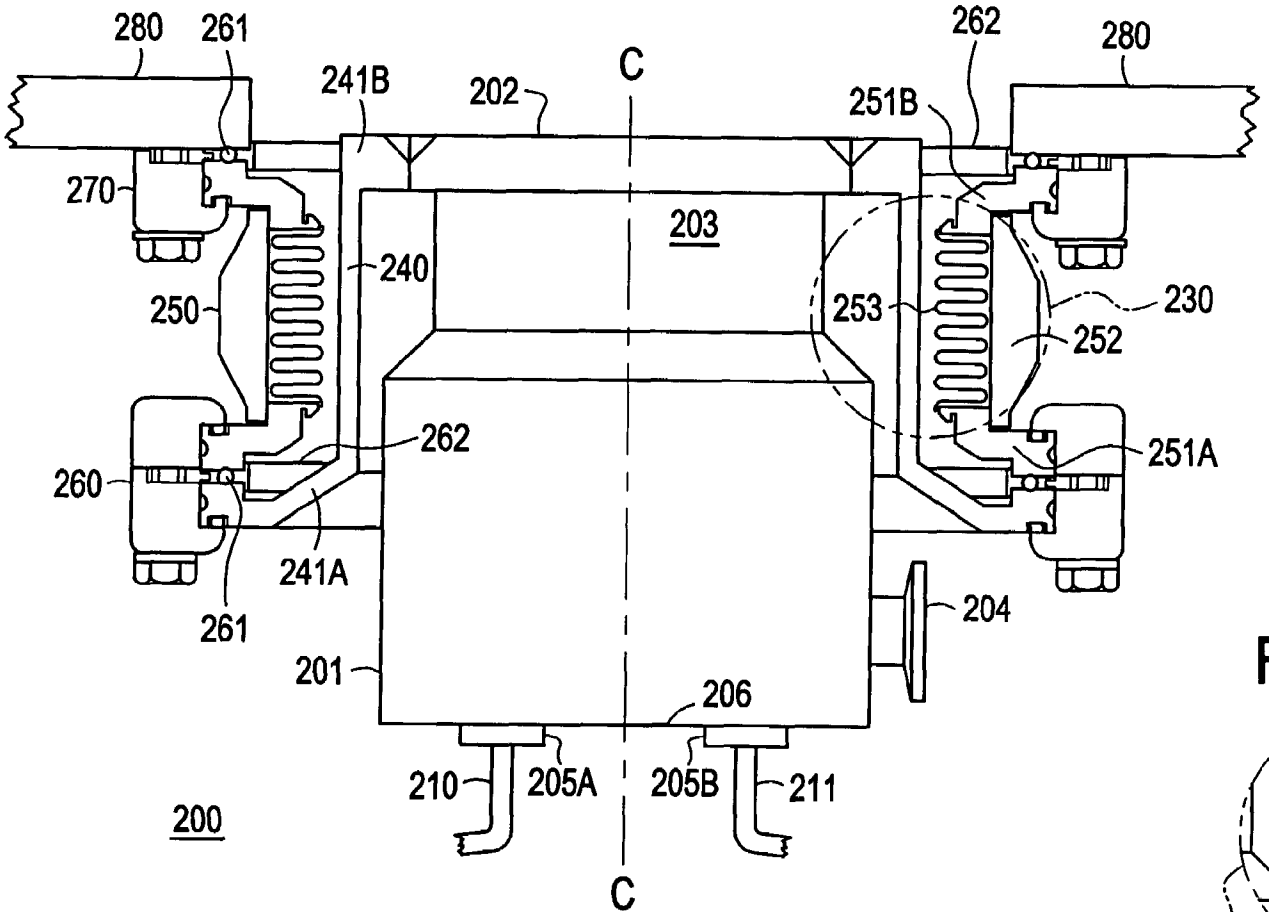
FIG. 3 is an illustration of a nested or parallel arrangement of a vibration damper and a turbo molecular vacuum pump, in accordance with a first exemplary embodiment of the present invention.

With reference to FIG. 3, an illustration is provided of a first exemplary embodiment of an arrangement of a vibration-damped turbo molecular vacuum pump nested within a vibration damper, forming a gas turbo pump assembly 200. The gas turbo pump assembly 200 according to the present invention may have a turbo pump 201 with substantially the same arrangement of rotor, stator and motor as that illustrated in FIG. 1, including a cylindrical outer body having a central axis C-C, but may differ with regard to the arrangements of conduits and passages and outer body structures, due to features of the invention, as subsequently explained. Disposed at one axial end of the cylindrical body of the pump 201 is a pump rim 202 that defines the end of an input port 203 and from which the pump 201 is suspended. At the opposite axial end of the body of the pump 201, and disposed in a radial orientation, is an exhaust port 204, which is arranged in a manner consistent with the conventional pump in FIG. 1. However, the bottom end 206 of the pump 201 may have one or more access ports 205A, 205B for providing electrical connections 210 or purge and cooling connections 211 to components disposed in the interior of the body of the pump 201. The purge and cooling connections, which may include a rough pumping port, cooling water inlet and outlet, and bearings gas purge, when provided at the bottom end, allow convenient access for connection and maintenance. While the components, including rotor and stator portions may be similar to those illustrated in FIG. 1, the connection at the bottom wall 206 of the pump 201 provides significant advantages for access related to assembly, servicing and repair. Further, the positioning of the access ports 205A and 205B frees the side portion of the cylindrical body of the pump 201 for coverage by the vibration damping assembly 230, which in the illustrated exemplary embodiment comprises a vibration damping structure 250 and a rigid support member 240.

In particular, the vibration damping structure 250, which has a bottom end support portion 251A and top end support portion 251B, is constructed in the same manner as in the damper structure 150. In this regard, the vibration damping structure 250 also includes bellow 253 and rubberized support 252. The vibration damping structure 250 is secured to the rigid input port structure 280 by clamp 270 and bolts (unnumbered), which are similar to the clamp 170 in FIG. 2. In addition, the opposite end of the vibration damping structure 250 is secured by a clamp 260 and bolts (unnumbered) to a rigid support member 240 that extends from a lower end of the vibration damping structure 250 toward the pump rim 202 for connection. In an exemplary embodiment, the combination of the vibration damping structure 250 and the support member 240 define a vibration damping assembly 230 having a substantially cone shape and being formed around the outside of the pump body in order to effectively suppress vibration. The clamp 260 is designed to affix the bottom end support portion 251A to the lower portion 241A of the rigid support member 240. A plurality of such clamps 260 are provided at plural circumferential positions of the vibration damping assembly 230. The upper portion 241B of the rigid support member 240 is secured to the rim 202 of the turbo vacuum pump 201 by welding, or the like, and the lower portion 241A of the support member 240 is secured to the lower part 251A by the clamp 260. With this arrangement, the pump 201 is flexibly affixed at its rim 202, via the substantially cone-shaped vibration damping assembly 230 to the input port structure 280, i.e., via the support portion 240 and damper 250. One or more centering rings 262 may be secured by the clamps 260, 270 and sealed by an O-ring 261, in order to ensure proper alignment of the pump with the rigid input port structure 280.

Figure 7A:
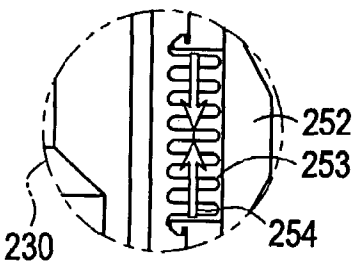
FIGS. 7A-7C illustrate details of certain forces that are operative to provide damping in the embodiments of FIGS. 3-5, respectively.

In operation, with the support member 240 being a rigid part and the flexible bellow damper 250 being a flexible part, and both being disposed in a substantially overlapping cone-shaped arrangement with a common connection at their bottom portions 241A and 251A, respectively, an effective damping arrangement can be obtained. In particular, with this structure, the damper will be compressed by the atmospheric pressure and will expand in response to vibration forces, thereby providing the desired damping effect. FIG. 7A illustrates the compression forces 254 that apply to the damper structure in this embodiment.

With this arrangement, the vibration damper 250 may be structured to surround the majority of the exterior surface of the body of the turbo pump 201, thereby providing an extensive vibration absorbing structure with the pump nested within the cavity of the vibration absorbing structure.

With the transfer of the utility access ports 205A, 205B to the bottom plate 206 of the vacuum pump 201, there is no obstruction to the vibration damper 250 covering a full two-thirds of the axial length of the turbo pump body. Optimally, the vibration damper will cover a significant portion, e.g., 50-90%, of the outer surface of the vacuum pump, however, it must be recognized that movement or other adjustment of the exit port or damper would be needed to achieve the upper range of coverage.

Figure 2:
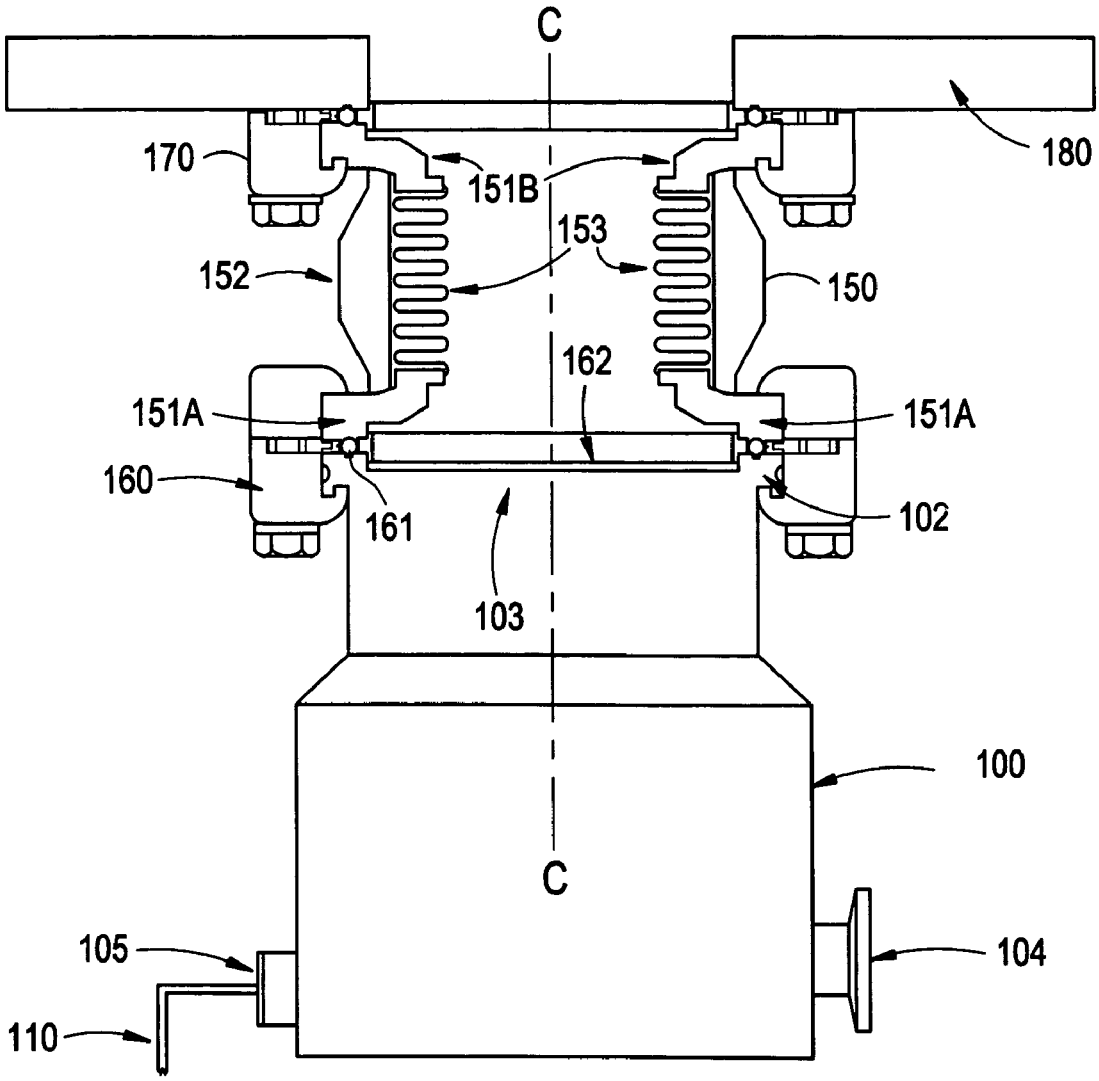
FIG. 2 PRIOR ART
FIG. 2 is an illustration of a prior art serial-coupled connection of a turbo molecular vacuum pump to a vacuum chamber inlet portion via a vibration damping mechanism.

Significantly, the vibration damping structure may be an off-the-shelf structure that is simply larger than one used in the serial connection in FIG. 2. For example, an ISO 160 size damper may be used instead of an ISO 100 size damper, which would be appropriate for damping in FIG. 2. However, because of the direct connection between the inlet port of the pump 203 and the inlet port of the vacuum chamber 280, a smaller size pump would be required. In particularly, rather than a 500 liter per second pump in a conventional design that is needed to obtain 300 liters per second effective pumping at the vacuum chamber inlet port, a 300 liter per second pump may be used. The difference is significant in both the size and cost of the pump, as the cost for a pump to supply a particular application may be reduced in half.

Figure 4:
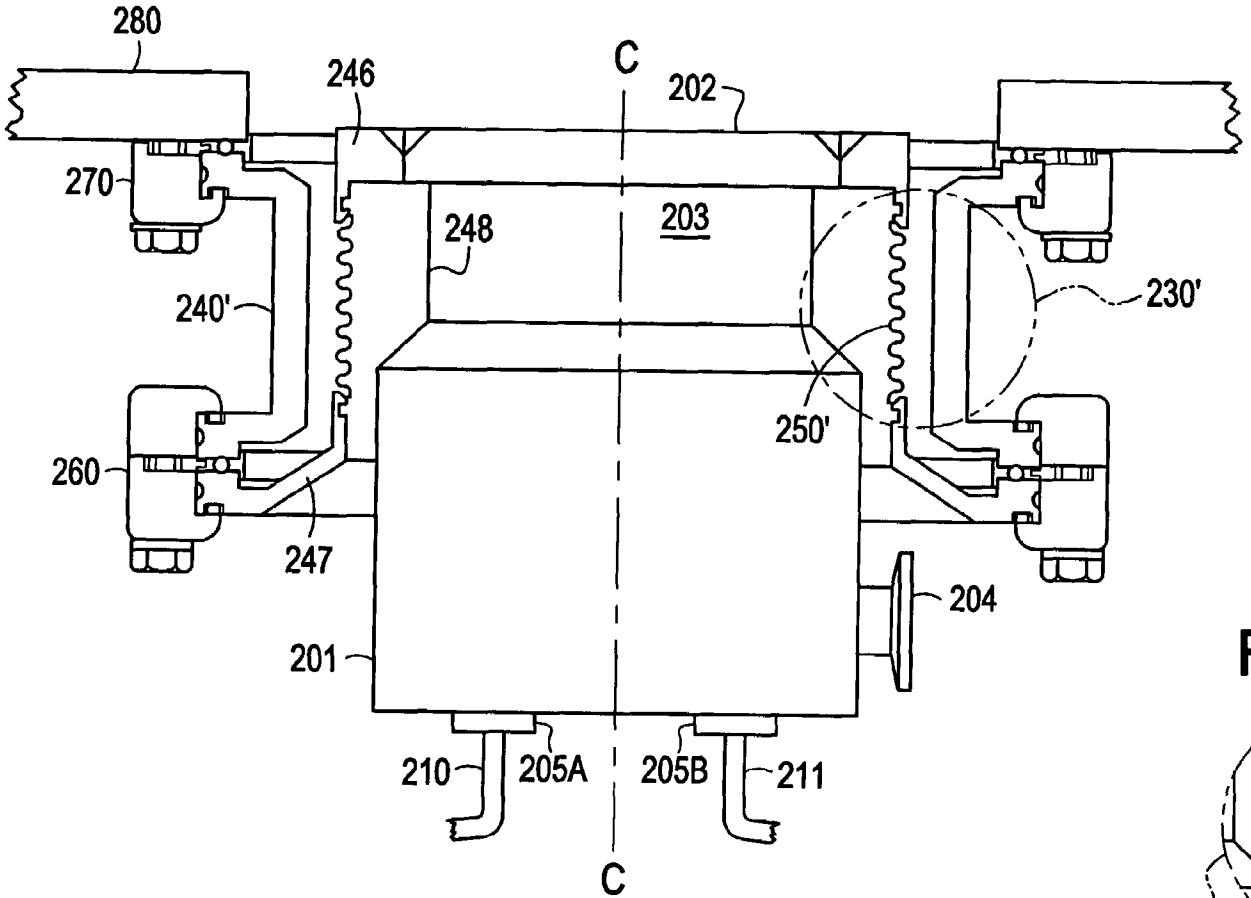
FIG. 4 is an illustration of a nested or parallel arrangement of a vibration damper and a turbo molecular vacuum pump, in accordance with a second exemplary embodiment of the present invention.

FIG. 4 shows a modification of a gas turbo pump assembly 200 of FIG. 3, particularly with respect to the vibration damper structure. Specifically, the embodiment of the gas turbo pump assembly in FIG. 4 uses a vibration damping assembly 230', which in the illustrated exemplary embodiment comprises a vibration damping structure 250' and a rigid support member 240' that are joined at their lower ends and define a generally cone shape. However, the solid support 240 that was adjacent the body of pump 201 in FIG. 3 has been replaced by an integrated support structure 250', comprising a combination of flexible bellows 248 and solid mounting top support 246 and bottom support 247. The top support 246 is attached to the top of the bellows 248 and is secured to the pump rim 202 in the same manner as the top 241B of the support 241 in FIG. 3. The bottom support 247 is attached to the bottom of the flexible bellows 248 and is secured to the bottom of a rigid support portion 240' in the same manner as the bottom 241A of the support 241 in FIG. 3.

Figure 7B:
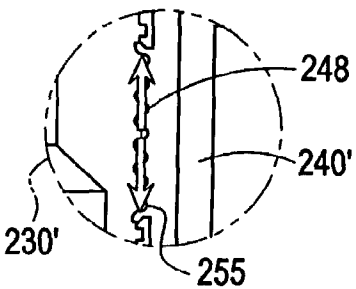

A detail of the vibration damping assembly 230' in FIG. 4 is illustrated in FIG. 7B. With the vibration damping structure 250' disposed closest to the pump and the solid part 240' disposed outside of the vibration damping structure 250', and the top 246 of the damping structure 250 affixed by welding or the like to the rim 202 of the pump and the top of the solid part 240' affixed to the rigid port structure 280, the damping structure 250' will be extracted by the atmospheric pressure according to forces 255. This is an opposite reaction to the case in FIG. 3, where the damping structure will be compressed.

Figures 5, 7C:
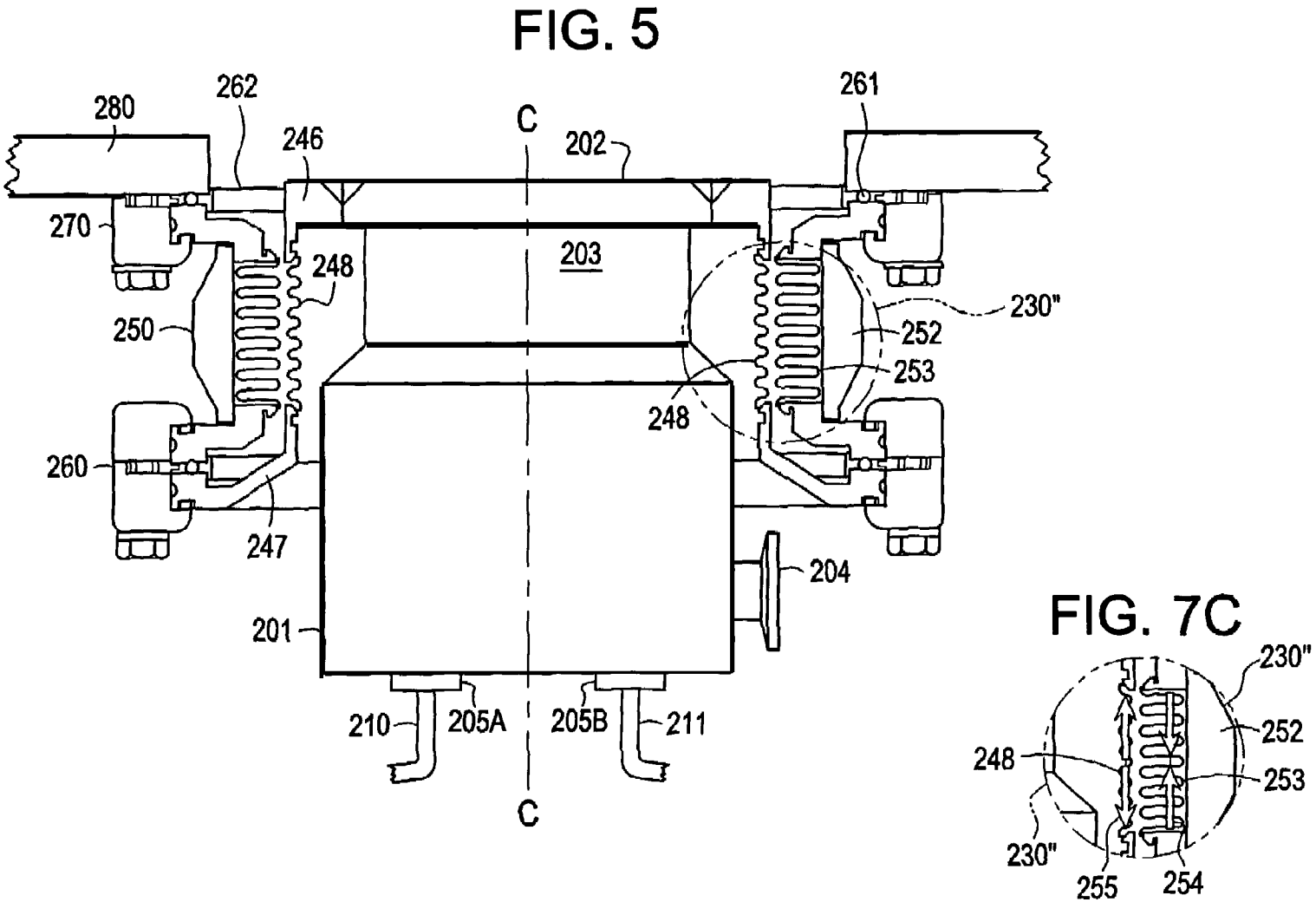
FIG. 5 is an illustration of a nested or parallel arrangement of a vibration damper and a turbo molecular vacuum pump, in accordance with a third embodiment of the present invention.

FIG. 5 shows yet another exemplary embodiment of a gas turbo pump assembly with yet another vibration damping arrangement. The embodiment of FIG. 5 uses a vibration damping assembly 230", which in the illustrated exemplary embodiment comprises a first vibration damping structure 250 and a second vibration damping structure 250' that are joined at their lower ends and define a substantially cone shape. The damping structures 250 and 250' are the same structures as disclosed with respect to FIGS. 3 and 4, respectively. The top support 246 of structure 250' is attached to the top of the bellows 248 and is secured to the pump rim 202 in the same manner as the top 241B of the support 241 in FIG. 3. The bottom support 247 is attached to the bottom of the bellows 248 and is secured to the bottom of the damping structure 250 in the same manner as the bottom 241A of the support 241 in FIG. 3.

A detail of the vibration damping assembly 230" in FIG. 5 is illustrated in FIG. 7C. With the vibration damping structure 250' disposed closest to the pump and the vibration damping structure 250 disposed outside of the vibration damping structure 250', and the top 246 of the damping structure 250 affixed by welding or the like (as indicated by the conventional welding symbol) to the rim 202 of the pump and the top of the damping structure 250' affixed to the rigid port structure 280, the damping structure 250' will be extracted by the atmospheric pressure and the damping structure 250 will be compressed. This permits the pump to be "floating" by the elimination of both the compression and extraction forces.

Figure 6:
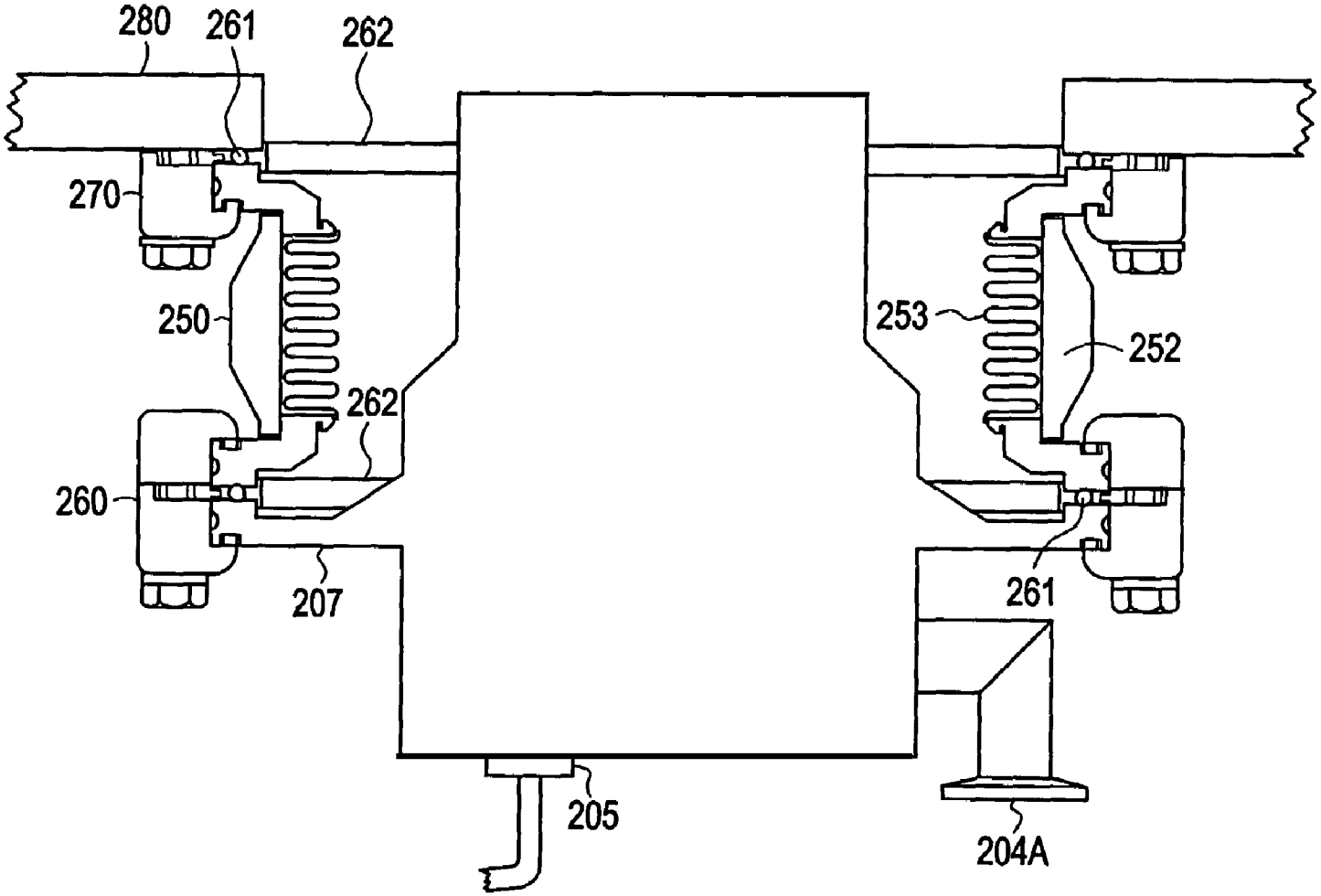
FIG. 6 is an illustration of a nested or parallel arrangement of a vibration damper and a turbo molecular vacuum pump, in accordance with a sixth embodiment of the present invention.

In FIG. 6, which is yet another embodiment of the invention, the body of pump 201 is girdled at a location axially away from the pump rim 202 by a radially extended and rigid support structure 207, preferably in the form of a support ring or radially extended tab or flange portion that is integrally formed on the body by welding, molding or the like, and whose purpose is explained subsequently. In addition, the opposite end of the vibration damper 250 is secured by a clamp 260 and bolts (unnumbered) to the support portion 207 that is formed around the outside of the body of pump 201 and is rigidly affixed via the support portion 207 on the pump body (or other similar structure for attaching the damper 250 to the lower part of the body) to the rim 202 of the pump. With this structure, the pump is supported at both the top rim and mid body positions, and not just at the top rim 202, as in the embodiments of FIGS. 3, 4 and 5.

In all cases illustrated in FIGS. 3, 4, 5 and 6, the pump will be nested substantially within the damper arrangement, and will permit a reduction in the loss of pumping speed in prior art designs, easier access to facilities connections and smaller size, thus lower cost.

The present invention comprises a combination of a vibration damper having a vacuum pump nested therein, as well as the vibration damper assembly itself, adapted to receive a conventional vacuum pump or specially adapted vacuum pump with bottom-access conduits and/or support ring structures. The vibration damper assembly 230, 230' and 230", as disclosed herein, may be sold in kit form, comprising one or more of a vibration damper 250, 250', rigid support members 240, 240' and bellows 246-248, as illustrated in the figures. The bellows may be made of metal and may be either formed or welded into an appropriate shape.

While the present invention has been described in connection with several exemplary embodiments, the invention further contemplates variations thereon, including variations or alternatives in materials, mechanical couplings and supports, that would be known to those skilled in the art.

What we claimed is:

1. A gas turbo pump assembly for connection to an inlet port, comprising:

a turbo pump having a pump body with an external surface and a center axis, a pump inlet port, said pump inlet port being disposed at a first axial end of said pump body and being coupled to a vacuum chamber port, and an exit port disposed proximate a second axial end of said body; and a vibration damping assembly, disposed to enclose a significant portion of said pump body in a nested arrangement, said vibration damping assembly comprising a first nested structure having an outer peripheral surface and an inner peripheral surface, said inner peripheral surface being disposed around and adjacent to the external surface of said significant portion of said pump body, and a second nested structure having an inner peripheral surface, said inner peripheral surface being disposed around and adjacent to the outer peripheral surface of said first nested structure, wherein said second nested structure comprises an arrangement of a flexible bellows and a rubberized support.

2. The turbo pump assembly as recited in claim 1, wherein said turbo pump is coupled to a rigid mounting structure at said pump inlet port via said vibration damping assembly.

3. The turbo pump assembly as recited in claim 2, wherein said vibration damping assembly is coupled between said rigid mounting structure and at least a first coupling portion at said first axial end of said pump body and a second coupling portion on the pump body disposed between said first axial end and said second axial end of said pump body.

4. The turbo pump assembly as recited in claim 3, wherein said second coupling portion comprises a radially extended structure integrally formed on said pump body.

5. The turbo pump assembly as recited in claim 4, wherein said coupling portion comprises a ring extended around said body.

6. The turbo pump assembly as recited in claim 4, wherein said coupling portion comprises a plurality of flanges disposed around said body.

7. The turbo pump assembly as recited in claim 1, wherein said first nested structure is a flexible damping structure having a first distal end and a second distal end and is coupled between said rigid mounting structure at the first distal end and said pump at the second distal end.

8. The turbo pump assembly as recited in claim 7, wherein said first nested structure comprises a flexible bellows.

9. The turbo pump assembly as recited in claim 7, wherein said second nested structure being a flexible structure having a first distal end and a second distal end and being coupled at the first distal end of said flexible structure to said pump at said first axial end and to the second end of said first nested structure at the second distal end of said flexible structure.

10. The turbo pump assembly as recited in claim 9, wherein at least one of said first nested structure and said second nested structure comprises at least one flexible bellows.

11. The turbo pump assembly as recited in claim 10, wherein both said first nested structure and said second nested structure are flexible and are adapted to reduce both compression and extraction forces.

12. The turbo pump assembly as recited in claim 1, wherein at least one of said first nested structure and said second nested structure comprises a flexible bellows.

13. The turbo pump assembly as recited in claim 1, wherein said flexible bellows is connected for extraction by atmospheric pressure.

14. The turbo pump assembly as recited in claim 1, wherein said exit port is disposed proximate said second axial end of said body, and is not covered by said vibration damping assembly.

15. The turbo pump assembly as recited in claim 1, wherein said body external surface further comprises an axial portion and an end portion, said end portion being substantially radially extended from said center axis to said axial portion and being adapted for receiving facilities connections.

16. The turbo pump assembly as recited in claim 1, wherein said significant portion comprises between 50% and 70% of said external side surface.

17. The turbo pump assembly as recited in claim 15, wherein said pump facilities connected though said bottom comprise one or more of a rough pumping port, cooling water inlet and outlet, bearings gas purge and electrical connections.

18. The turbo pump assembly as recited in claim 1 where the vibration damping assembly defined by the first nested structure and the second nested structure is substantially cone shaped.

19. A gas turbo pump assembly for connection to an inlet port, comprising:

a turbo pump having a pump body with an external surface and a center axis, a pump inlet port, said pump inlet port being disposed at a first axial end of said pump body and being coupled to a vacuum chamber port, and an exit port disposed proximate a second axial end of said body; and a vibration damping assembly, disposed to enclose a significant portion of said pump body in a nested arrangement, said vibration damping assembly comprising a first nested structure having an outer peripheral surface and an inner peripheral surface, said inner peripheral surface being disposed around and adjacent to the external surface of said significant portion of said pump body, and a second nested structure having an inner peripheral surface, said inner peripheral surface being disposed around and adjacent to the outer peripheral surface of said first nested structure, wherein said first nested structure is a flexible damping structure having a first distal end and a second distal end and is coupled between said rigid mounting structure at the first distal end and said pump at the second distal end, and wherein said second nested structure is a rigid structure having a first distal end and a second distal end and is coupled to said pump body at the first distal end of said rigid structure and the second distal end of said first connecting structure at the second distal end of said rigid structure.

20. The turbo pump assembly as recited in claim 19 where the vibration damping assembly defined by the first connection structure and the second connection structure is substantially cone shaped.

21. A vibration damping assembly for substantially enclosing a gas turbo pump in a nested fashion, and securing the pump to an inlet port, comprising:

a vibration damping structure defining an enclosure having at axially opposed ends a first and second opening, respectively, said first opening being adapted for coupling to an inlet port and said second opening being adapted to receive therein a substantial portion of the pump, said vibration damping structure comprising a first nested structure and a second nested structure, said first nested structure being a rigid support structure having first and second ends and being adapted to being coupled between a rigid mounting structure at the first end and said second nested structure at the second end, said second nested structure being flexible and being coupled between said pump body at said first axial end and said first nested structure.

22. The turbo pump assembly as recited in claim 21, wherein said vibration damper comprises a flexible bellows.

* * * * *